United States Patent [19]

Rössler

[11] Patent Number: 5,005,614

[45] Date of Patent: Apr. 9, 1991

[54] MACHINE FOR CRUSHING MATERIAL

[76] Inventor: Peter Rössler, Bustadtstr. 20, D-7129 Ilsfeld, Fed. Rep. of Germany

[21] Appl. No.: 479,951

[22] Filed: Feb. 14, 1990

[30] Foreign Application Priority Data

Aug. 23, 1989 [DE] Fed. Rep. of Germany ..... 8910075

[51] Int. Cl.[5] ..... B02C 18/08

[52] U.S. Cl. ..... 241/73; 241/160; 241/285 A

[58] Field of Search ..... 241/73, 74, 294, 160, 241/243, 280, 285 R, 81, 285 A, 189 R, 190, 154

[56] References Cited

U.S. PATENT DOCUMENTS 229,205 6/1880 Thompson et al. ..... 241/160

1,645,770 10/1927 Olson ..... 241/160 X

FOREIGN PATENT DOCUMENTS 1188345 12/1956 France ..... 241/160

492904 12/1955 Italy ..... 241/160

*Primary Examiner*—Mark Rosenbaum

*Attorney, Agent, or Firm*—Fred Philpitt

[57] ABSTRACT

A machine for crushing even soft material remains that has two crushing rollers (36, 38) driven by independent drives, which rollers co-operate with stationary crushing racks (30, 62). Screens (38, 66) located behind the two crushing rollers (36, 56) are connected on their under side to a common collecting chamber (46) for material chips.

11 Claims, 2 Drawing Sheets

MACHINE FOR CRUSHING MATERIAL

The invention relates to a machine for crushing wood, chipboards, fibre boards and the like.

Known crushing machines of this type are well-suited for crushing or shredding wood remains, chipboards and hard fibre boards. However, for some applications it would be desirable if one could even crush soft fibre boards with a crushing machine of this type. In the known crushing machine, these soft fibre boards may deviate upwards from the crushing roller, so that they remain uncrushed in the storage container.

The present invention therefore intends to develop a crushing machine which is suitable for crushing light and not absolutely rigid material remains.

In the crushing machine according to the invention, also provided above the crushing roller is an additional crushing roller, which on the one hand sends light and soft material remains travelling upwards back to the lower crushing roller, on the other hand itself also accomplishes crushing of the material and even reduces to chip form material remains obstinately remaining above the first crushing roller. The material chips, which are produced by the second crushing roller, are guided together with the material chips produced by the first crushing roller, so that one requires only a single discharge device (worm conveyor or fan).

The development of the invention is of advantage with regard to the most effective possible guidance of material remains from the first to the second crushing roller. The two peripheral surfaces of the two crushing rollers thus form a dynamic hopper, which leads to the chip-forming points.

With the development of the invention it is ensured that the second crushing roller can be located relatively close to a side or end wall of the storage container.

Even the development of the invention is an advantage with regard to good further sliding of the material remains from the working region of the second crushing roller to the working region of the first crushing roller.

In my crushing machine, it is ensured that material remains also cannot accumulate above the second crushing roller.

The development of the invention is an advantage with regard to economical production of two types of crushing machines, which contain an additional second crushing roller or contain solely the main crushing roller. For the production of the type which is suitable for crushing soft material remains, one needs solely to insert an intermediate part between the standard parts of the simple machine type. If necessary this can also be carried out at the installation point and subsequently.

With the development of the invention it is ensured that the material remains to be crushed are moved positively in the axial direction of the crushing roller at the chip-forming point, so that they are necessarily located opposite the crushing tools in a constantly changing orientation.

The development of the invention involves a particularly simple production of helical ribbed roller cores.

In a crushing machine according to the invention, on the one hand one can attach very hard and wear-resistant crushing tools in a simple manner to the crushing roller core; in addition, these crushing tools may also be reversed in a simple manner in order to use their various working edges in succession.

With the development of the invention it is possible to distribute the chip-cutting capacity in the most advantageous manner to the two crushing rollers. Also, the upper crushing roller can be left to be completely stationary, if solely hard material remains such as wood remains are crushed.

The development of the invention has the advantage that no mechanical driving connections must be made between the lower part and the intermediate part of the storage container. The intermediate part of the storage container with the second crushing device is mechanically self-sufficient.

The invention will be described in detail hereafter by means of one embodiment by referring to the drawings, in which.

Figure 1:
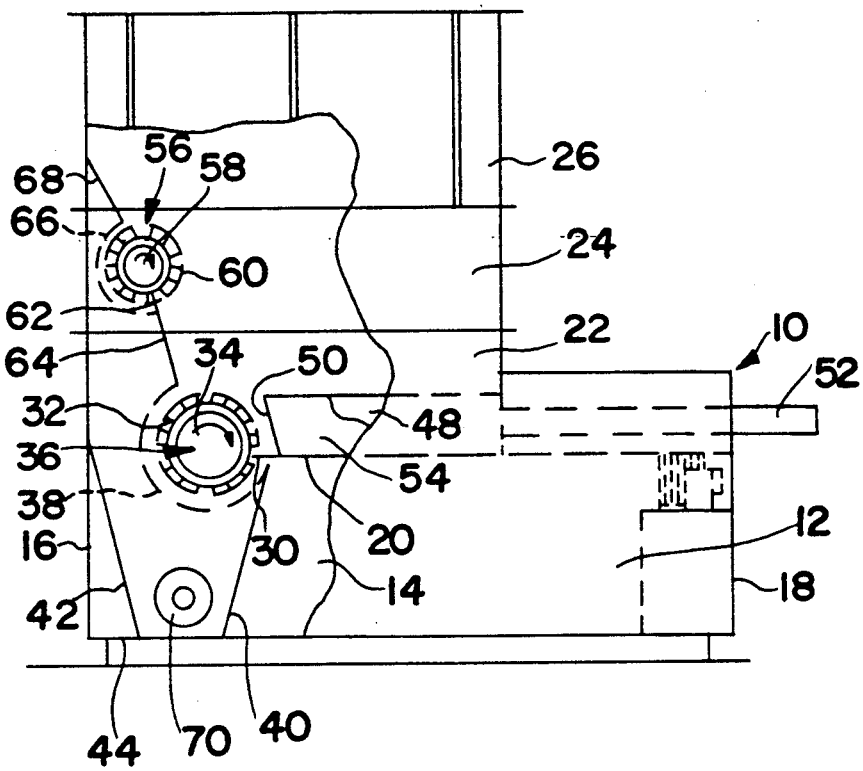
FIG. 1 is a side view of a machine for crushing material remains, part of one side wall being cut away.

The crushing machine illustrated in the drawing has a lower machine part designated generally by the reference numeral 10. The latter comprises a front wall 12, a rear wall 14 and end walls 16, 18. Together with a central, horizontal base wall 20, these walls define a lower part 22 of the storage container. The cross-section of the former is rectangular and an intermediate part 24 of the storage container is flange-mounted on its free upper edge. The latter in turn supports an upper part 26 of the storage container by way of connecting flanges. The intermediate part 24 of the storage container and the upper part 26 of the storage container again have a rectangular cross-section and form a vertical chute with the lower part 22 of the storage container.

Figure 2:
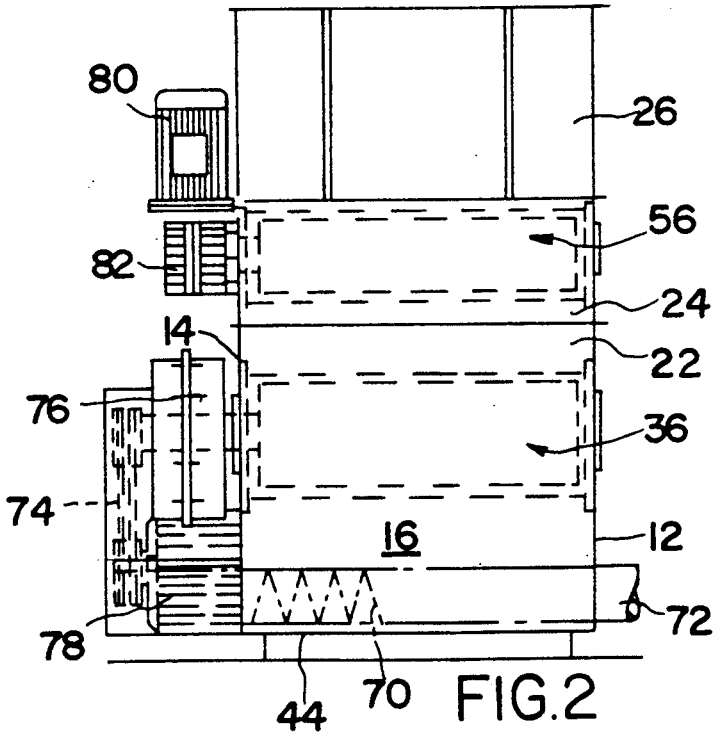
FIG. 2 is a plan view of the front end of the crushing machine located on the left in FIG. 1.

The base wall 20 extends solely over approximately 60% of the width of the lower part 22 of the storage container and on its free edge located on the left in FIG. 1 supports a crushing rack 30 with a plurality of triangular crushing prongs following each other perpendicular to the plane of the drawing, which are not illustrated in FIGS. 1 and 2. Complementary triangular crushing tools 32 travel with clearance between the crushing prongs of the crushing rack 30, which tools are disposed on the peripheral surface of a crushing roller core 34 along a helical line. The crushing roller formed by the crushing roller core 34 and the crushing tools 32 generally bears the reference numeral 36.

The crushing roller 36 is surrounded by a concentric screen 38, which starting from the free edge of the base wall 20 extends over an angle of approximately 270°. A first hopper wall 40 also extends obliquely downwards from the free end of the base wall 20, which wall 40 together with a hopper wall 42 placed in front of the end wall 16 and a base plate 44 of the lower part 10 of the machine forms a collecting chamber 46 for material chips produced at the time of crushing the material remains by the crushing roller 36.

Mounted to move horizontally on the base plate 44 is a slide 48, which comprises an end face 50 inclined towards the peripheral surface of the crushing roller 36 and can be moved by a double acting working cylinder 52 towards the crushing roller 36, in order to bring material remains standing or lying on the base wall 20 into the operative region between the crushing roller 36 and the crushing rake 30. The control for the working cylinder 52 may take place for example purely on a timed basis.

In order to prevent jamming of pieces of material between the side faces of the slide 48 and the front wall 12 or the rear wall 14 of the lower part 10 of the machine, sealing members 54 made from synthetic material lie between the two side faces of the slide 48 and the said walls, the edge contour of which sealing members corresponds substantially to the edge contour of the side faces of the slide.

Located in the intermediate part 24 of the storage container, on the left in FIG. 1, above the crushing roller 36 is a second crushing roller 56, which has a similar construction to the crushing roller 36, but has a smaller diameter. Crushing tools 60 are again located on a crushing roller core 58 with an outer surface in the form of helical ribs.

The crushing roller 56 co-operates with a crushing rake 62, which is located at the upper end of a guide wall 64. The guide wall 64 is free from openings and extends from the upper end of the screen 38 to the lower end of a screen 66 surrounding the crushing roller 56 concentrically, which has a circumferential extent of approximately 170°. As shown in FIG. 1, the guide wall 64 extends approximately in the direction of the connecting line of the axis of the crushing roller 36 and the axis of the crushing roller 56. A further guide wall 68 extends from the upper end of the screen 66 to the left-hand side wall of the upper part 26 of the storage container.

If soft material remains of chip-formation by the lower crushing roller 36 attempt to deviate due to the fact that they travel upwards in the storage chamber, then they reach the upper crushing roller 56. Its crushing tools 60 on the one hand move material remains of this type back in a downwards direction towards the crushing roller 36 and if, despite this influence, the material remains do not return to the crushing roller 36, they are crushed by the crushing tools 60 and the crushing rake 62. The material chips produced in this way drop downwards and like the material chips produced by the crushing roller 36 and the crushing rake 30 reach the collecting chamber 46.

A worm conveyor 70 extends through the collecting chamber 46, which conveyor conveys the material chips to a pipe 72, which leads to a silo.

As shown in FIG. 2, separate drive units are provided for the crushing rollers 36 and 56:

The crushing roller 36 is driven by way of a belt drive 74 and reduction gearing 76 by an electric motor 78. An electric motor 80, which is small in comparison with the former, drives the upper crushing roller 56 by way of reduction gearing 82.

Figure 3:
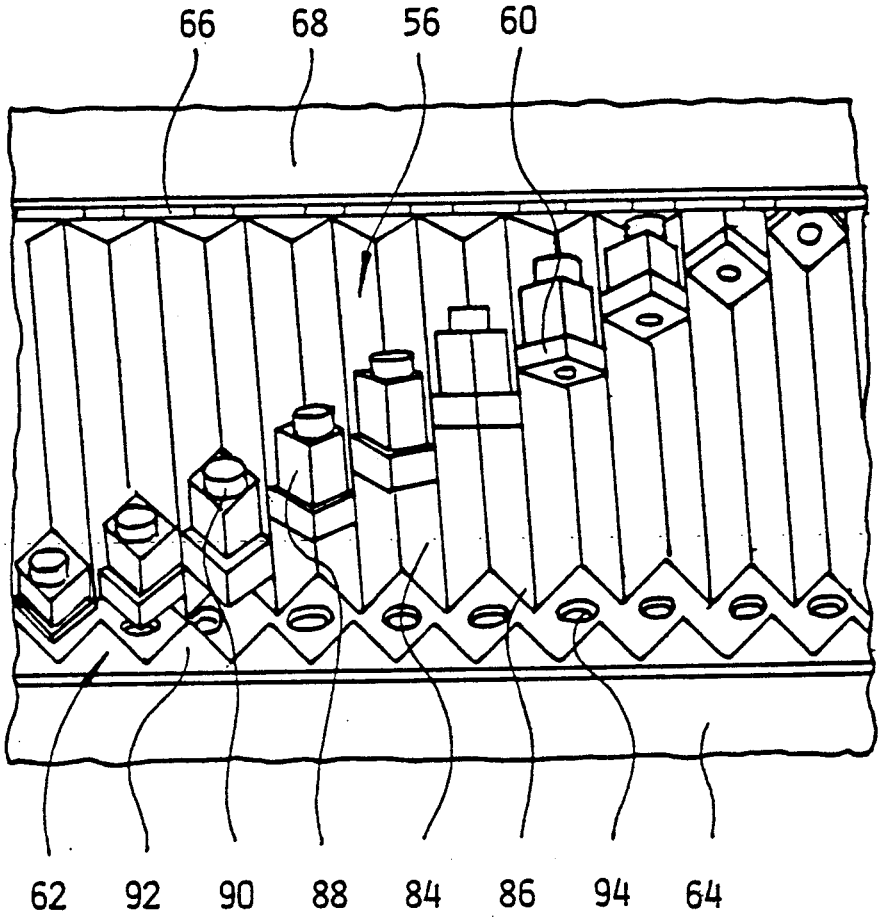
FIG. 3 is an enlarged plan view of part of an upper crushing device of the crushing machine according to FIGS. 1 and 2.

FIG. 3 shows details of the upper crushing device, which comprises the crushing roller 56 and the crushing rake 62.

As shown in FIG. 3, the crushing roller core 58 consists of a plurality of discs 84 stacked axially one behind the other, whereof the end faces are arranged obliquely with respect to the axis of the roller. The discs 84 have an edge 86 comprising a triangular cross-section, so that as a whole the stack of discs forms a crushing roller core with an outer contour similar to a worm conveyor.

In the gaps between the edges 86 having a triangular cross-section, diamond-shaped tool holders 88 are welded between the discs 84. The diamond-shaped crushing tools 58 are screwed to the latter by means of screws 90, which tools 58 project beyond the crushing roller core 58 by half their diamond-shaped contour.

Below the crushing roller 56 can be seen the crushing rake 62 with its individual, triangular crushing fingers 92, the sides of which are arranged to correspond to the sides of the crushing tools 58, so that the latter may pass with clearance between the crushing fingers 92.

Holes 94 of the screen 66 can be seen in FIG. 3.

FIG. 3 also shows clearly that the crushing tools 60 are seated along a helical line on the crushing roller core 58.

I claimed:

1. A machine for crushing material remains, which includes in combination (a) a storage container (20–26) for the material to be crushed, (b) a lower crushing roller (36) located close to a base of the storage container, which roller (36) comprises a plurality of crushing tools (32) projecting radially from a crushing roller core (34), and which cooperates with a first stationary crushing rack (30), (c) a first screen (38) disposed adjacent the lower crushing roller (36) through which crushed remains pass, (d) a collecting chamber (46) located below the first screen (38) for material chips produced at the time of crushing, (e) a slide (48) located above a base plate (44) of the storage container which is adapted to be moved across said base plate (44) intermittently towards said lower crushing roller (56) to initially feed material to the lower crushing roller (36), (f) an upper crushing roller (56) above said lower crushing roller (36) which is mounted on a crushing roller core (58) and supports a plurality of radially projecting crushing tools (60), and cooperates with a second stationary crushing rack (62), (g) an active peripheral region of the upper crushing roller (56) having a speed component directed towards said lower crushing roller (36), and (h) a second screen (66) positioned adjacent said upper crushing roller (56) through which crushed remains pass, and (i) a space behind the second screen (66) that is also connected to the collecting chamber (46), said upper crushing roller (56) thus crushing material not crushed by the lower crushing roller (36).

2. A crushing machine according to claim 1 wherein said upper crushing roller (56) is offset from said lower crushing roller (36) in the direction of one end wall of the storage container (22–26).

3. A crushing machine according to claim 1 wherein said upper crushing roller (56) has a smaller diameter than said lower crushing roller (36).

4. A crushing machine according to claim 1 wherein the lower end of said second screen (66) is connected to the upper end of said first screen (38) by a guide wall (64).

5. A crushing machine according to claim 1 wherein an inclined guide wall (68) extends from the upper end of the second screen (66) to the adjacent end wall of the storage container (22–26), the inclination of which corresponds approximately to the inclination of the connecting line of the crushing roller axes.

6. A crushing machine according to claim 1 wherein said upper crushing roller (56), said second screen (66) and said second crushing rack (62) are supported by an intermediate container part (24), which can be inserted between a standard upper container part (26) and a standard lower container part (22) of the storage container (20–26), said lower crushing roller (36), said first screen (38) and said first crushing rack (30) being associated with the lower container part.

7. A crushing machine according to claim 1 wherein said crushing roller core (58) of said upper crushing roller (56) is constructed as a helical ribbed member.

8. A crushing machine according to claim 7 wherein the ribs of said upper crushing roller core (58) have a triangular cross-section.

9. A crushing machine according to claim 7 wherein tool holders (88) are inserted between the ribs of said upper crushing roller core (58) which support the crushing tools (60).

10. A crushing machine according to claim 1 wherein independent drives (78, 80) are associated with said two crushing rollers (36, 56).

11. A crushing machine according to claim 10 wherein the drive (80, 82) for said upper crushing roller (56) is supported by the intermediate container part (24) of the storage container.

* * * * *